US007937808B1

(12) United States Patent
Chuang

(10) Patent No.: US 7,937,808 B1
(45) Date of Patent: May 10, 2011

(54) CURTAIN CARRIER HAVING A SIMPLIFIED CONSTRUCTION

(76) Inventor: Shan-Chi Chuang, Wugu Township, Taipei County (TW)

( * ) Notice: Subject to any disclaimer, the term of this patent is extended or adjusted under 35 U.S.C. 154(b) by 324 days.

(21) Appl. No.: 12/206,911

(22) Filed: Sep. 9, 2008

(51) Int. Cl.
*A47H 13/00* (2006.01)
*E05D 15/00* (2006.01)

(52) U.S. Cl. ..... 16/87.2; 16/87.6 R; 16/91; 16/106; 16/107

(58) Field of Classification Search ..... 16/87.6 R, 16/87.2, 87 R, 87.4 R, 91, 97, 102, 107, 106, 16/45, 46; 160/330, 340, 341, 345–347, 160/123; 49/409, 410, 411, 412; 384/531–532
See application file for complete search history.

(56) References Cited

U.S. PATENT DOCUMENTS

| | | | | |
|---|---|---|---|---|
| 1,232,563 | A * | 7/1917 | Kail | 16/105 |
| 3,076,222 | A * | 2/1963 | Sloan | 16/98 |
| 3,293,685 | A * | 12/1966 | Rosenbaum | 16/87.6 R |
| 4,049,308 | A * | 9/1977 | Martin | 295/8 |
| 6,189,182 | B1 * | 2/2001 | Ko | 16/87.6 R |
| 7,698,781 | B2 * | 4/2010 | Cai | 16/87.2 |

* cited by examiner

*Primary Examiner* — Chuck Y. Mah
(74) *Attorney, Agent, or Firm* — Alan Kamrath; Kamrath & Associates PA

(57) ABSTRACT

A curtain carrier includes a carrier body having a mounting ring which has an inner wall provided with a sliding face, a first support seat having a connecting tube which is inserted into the mounting ring and has an inner wall provided with an engaging hole, a second support seat having an engaging sleeve which is inserted into and closely fit in the engaging hole, and a rolling module located between the first support seat and the second support seat and slidably mounted between the sliding face and the connecting tube. Thus, the curtain carrier has a simplified construction, thereby greatly decreasing the cost of fabrication. In addition, the first support seat and the second support seat are assembled easily and quickly, thereby facilitating assembly of the curtain carrier.

17 Claims, 6 Drawing Sheets

CURTAIN CARRIER HAVING A SIMPLIFIED CONSTRUCTION

BACKGROUND OF THE INVENTION

1. Field of the Invention

The present invention relates to a curtain carrier and, more particularly, to a curtain carrier to carry a curtain cloth.

2. Description of the Related Art

A conventional curtain carrier in accordance with the prior art shown in FIGS. 5 and 6 comprises a carrier body 50, a first support seat 60, a second support seat 80, a rolling module 70, and a retaining ring 90. The carrier body 50 has a first end provided with a mounting ring 51 and a second end provided with a connecting plate 52. The connecting plate 52 of the carrier body 50 has a surface provided with a hanging hole 521. The mounting ring 51 of the carrier body 50 has an inner wall provided with a first stop rib 511, a second stop rib 512 and an annular groove 513 located between the first stop rib 511 and the second stop rib 512. The first support seat 60 includes a first tube 62 inserted into the mounting ring 51 of the carrier body 50 and a first stop plate 61 formed on an outer wall of the first tube 62 and abutting the first stop rib 511 of the mounting ring 51. The first support seat 60 has an inside provided with a through hole 63 which has a periphery provided with an annular retaining flange 631. The first tube 62 of the first support seat 60 has an outer wall provided with an annular groove 621. The second support seat 80 includes a second tube 83 inserted into the through hole 63 of the first support seat 60 and a second stop plate 82 formed on an outer wall of the second tube 83 and abutting the second stop rib 512 of the mounting ring 51. The second support seat 80 has an inside provided with a shaft hole 81. The second tube 83 of the second support seat 80 has an outer wall provided with an annular retaining groove 831 to retain the retaining flange 631 of the first support seat 60. The second tube 83 of the second support seat 80 has a periphery provided with a plurality slots 832 connected to the shaft hole 81 to make the second tube 83 of the second support seat 80 flexible. The rolling module 70 is mounted between the first tube 62 of the first support seat 60 and the mounting ring 51 of the carrier body 50 and between the first stop plate 61 of the first support seat 60 and the second stop plate 82 of the second support seat 80. The retaining ring 90 is mounted on the first tube 62 of the first support seat 60 and has a first side provided with a mounting hole 92 mounted on the first tube 62 of the first support seat 60 and a second side provided with a plurality of receiving recesses 93 to receive the rolling module 70.

However, the conventional curtain carrier has a very complicated construction, thereby greatly increasing the cost of fabrication. In addition, the conventional curtain carrier is not assembled easily and quickly, thereby causing inconvenience in assembly of the curtain carrier.

BRIEF SUMMARY OF THE INVENTION

In accordance with the present invention, there is provided a curtain carrier, comprising a carrier body having a first end provided with a mounting ring which has an inner wall provided with a sliding face, a first support seat having a connecting tube which is inserted into the mounting ring of the carrier body and has an inner wall provided with an engaging hole, a second support seat having an engaging sleeve which is inserted into and closely fit in the engaging hole of the connecting tube of the first support seat, and a rolling module located between the first support seat and the second support seat and slidably mounted between the sliding face of the mounting ring of the carrier body and the connecting tube of the first support seat.

The primary objective of the present invention is to provide a curtain carrier having a simplified construction to decrease the cost of fabrication.

Another objective of the present invention is to provide a curtain carrier, wherein the curtain carrier consists of a carrier body, a first support seat, a second support seat and a rolling module, so that the curtain carrier has a simplified construction, thereby greatly decreasing the cost of fabrication.

A further objective of the present invention is to provide a curtain carrier, wherein when the first support seat and the second support seat are combined, the reduced insert of the engaging sleeve is inserted through the guide slot into the engaging hole of the connecting tube and is guided by the oblique guide face of the connecting tube, so that the first support seat and the second support seat are assembled easily and quickly, thereby facilitating assembly of the curtain carrier.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
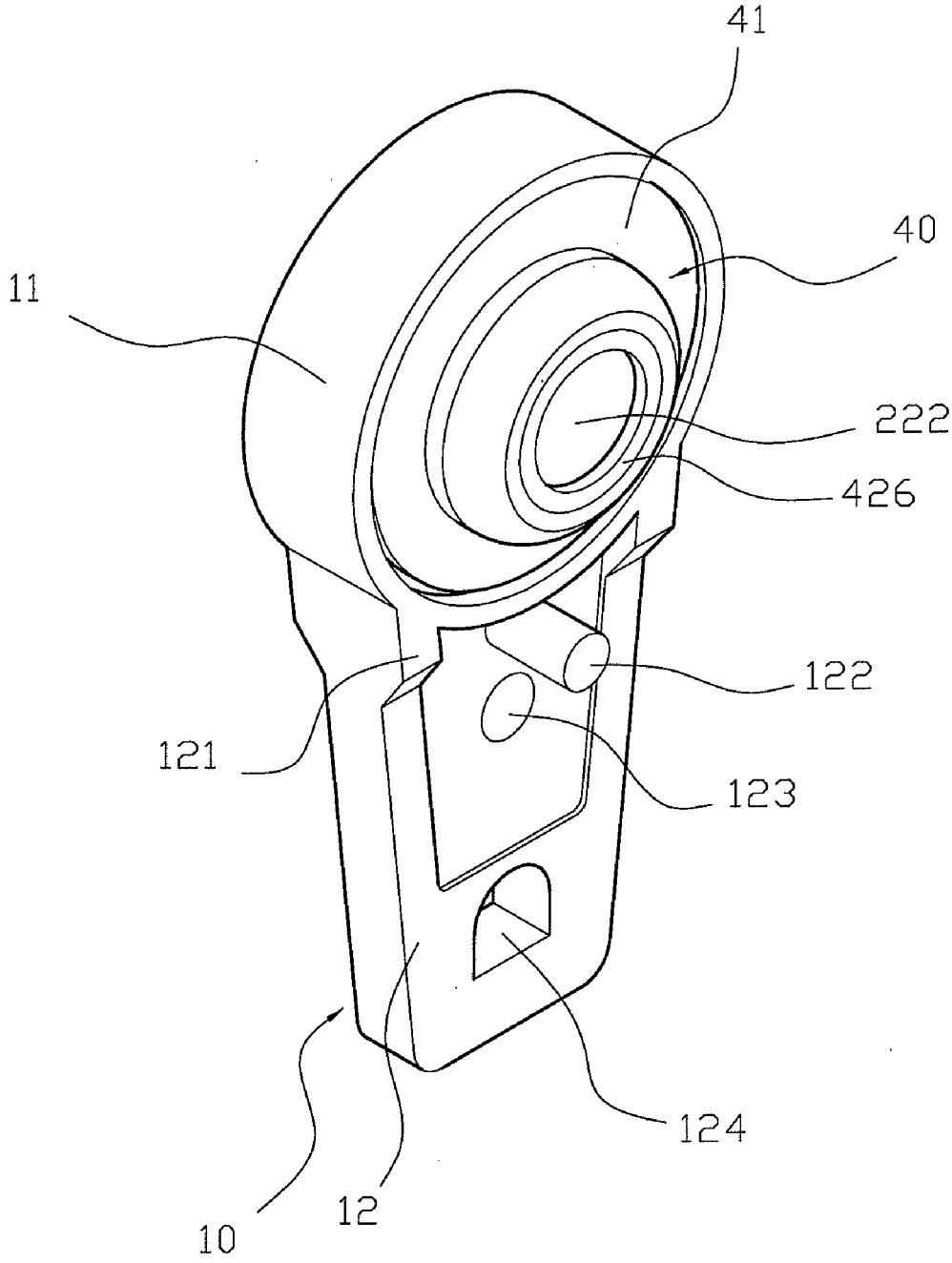
FIG. 1 is a perspective view of a curtain carrier in accordance with the preferred embodiment of the present invention.
Figure 2:
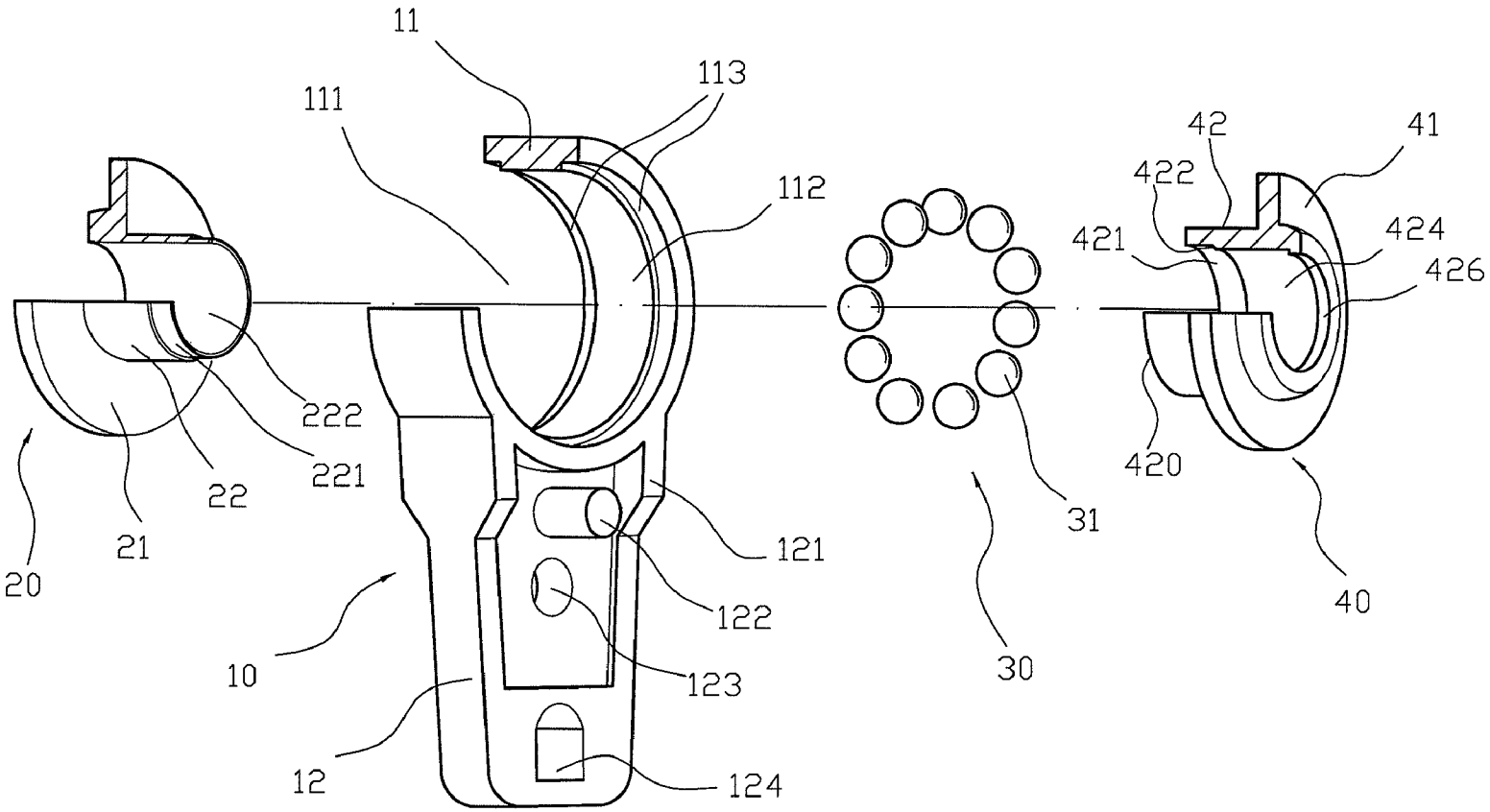
FIG. 2 is a partially exploded perspective cross-sectional view of the curtain carrier as shown in FIG. 1.
Figure 3:
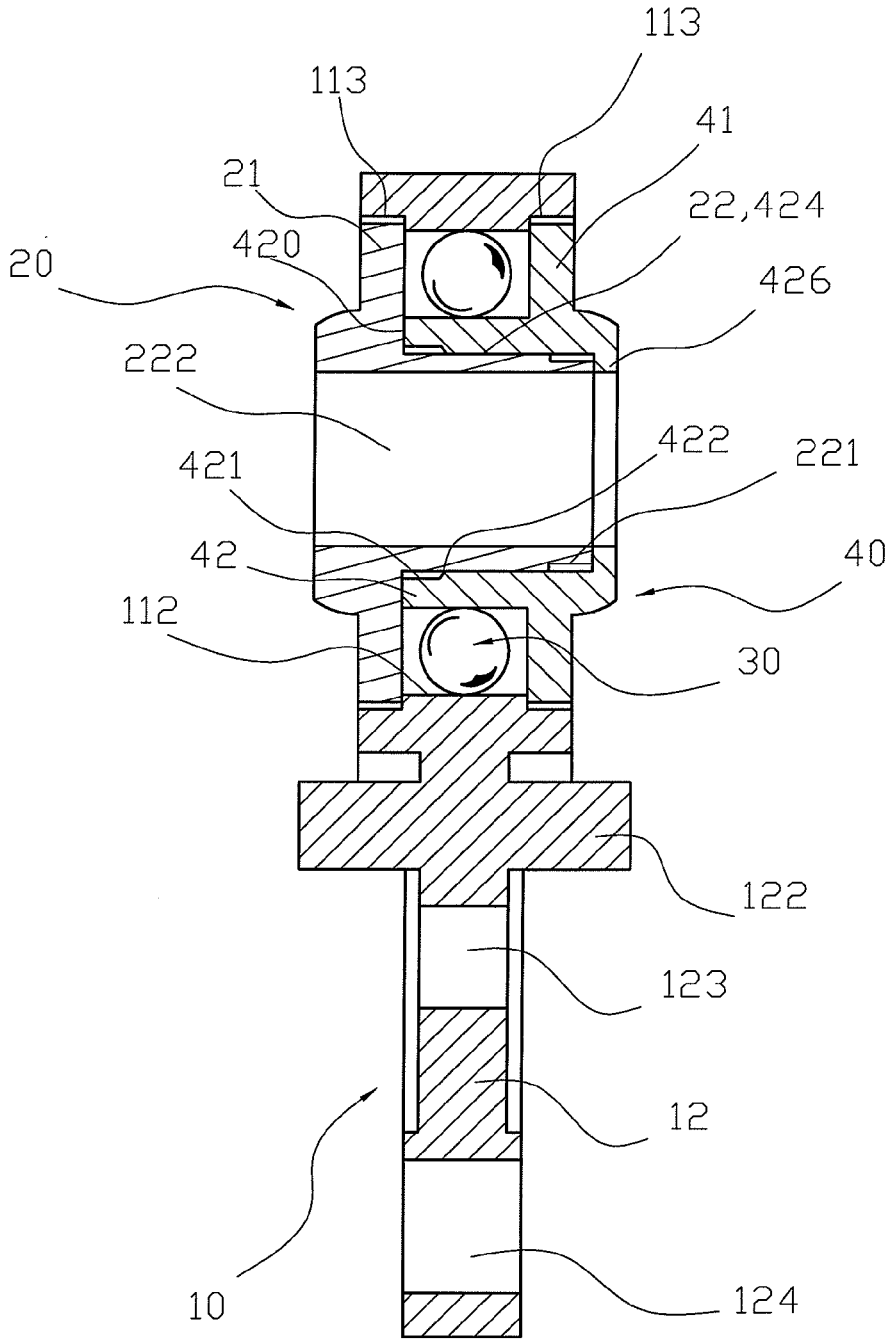
FIG. 3 is a side cross-sectional view of the curtain carrier as shown in FIG. 1.

Referring to the drawings and initially to FIGS. 1-3, a curtain carrier in accordance with the preferred embodiment of the present invention comprises a carrier body 10 having a first end provided with a mounting ring 11 which has an inner wall provided with a sliding face 112, a first support seat 40 having a connecting tube 42 which is inserted into the mounting ring 11 of the carrier body 10 and has an inner wall provided with an engaging hole 424, a second support seat 20 having an engaging sleeve 22 which is inserted into and closely fit in the engaging hole 424 of the connecting tube 42 of the first support seat 40, and a rolling module 30 located between the first support seat 40 and the second support seat 20 and slidably mounted between the sliding face 112 of the mounting ring 11 of the carrier body 10 and the connecting tube 42 of the first support seat 40.

The first support seat 40 has a first stop plate 41 formed on an outer wall of the connecting tube 42 and abutting the mounting ring 11 of the carrier body 10. The connecting tube 42 of the first support seat 40 has a first end abutting the second support seat 20 and a second end provided with the first stop plate 41. The engaging hole 424 of the connecting tube 42 has a first end provided with an enlarged guide slot 421 to allow entrance of the engaging sleeve 22 of the second support seat 20 and a second end provided with a radially and inwardly extending stop flange 426 to stop movement of the engaging sleeve 22 of the second support seat 20. The engaging hole 424 of the connecting tube 42 has a diameter smaller than that of the guide slot 421 and greater than that of the stop flange 426. The guide slot 421 of the connecting tube 42 has a stepped shape and has a side provided with an oblique guide face 422 to guide movement of the engaging sleeve 22 of the second support seat 20.

The second support seat 20 has a second stop plate 21 formed on an outer wall of the engaging sleeve 22 and abutting the mounting ring 11 of the carrier body 10, and the first end of the connecting tube 42 has an end face 420 abutting the second stop plate 21 of the second support seat 20. The engaging sleeve 22 of the second support seat 20 has an inner wall provided with a through hole 222. The engaging sleeve 22 of the second support seat 20 has a first end provide with a reduced insert 221 abutting the stop flange 426 of the connecting tube 42 and a second end provided with the second stop plate 21. The reduced insert 221 of the engaging sleeve 22 has a stepped shape. The reduced insert 221 of the engaging sleeve 22 is inserted through the guide slot 421 into the engaging hole 424 of the connecting tube 42 and is guided by the oblique guide face 422 of the connecting tube 42. The reduced insert 221 of the engaging sleeve 22 has a thickness smaller than that of the engaging sleeve 22 of the second support seat 20.

The mounting ring 11 of the carrier body 10 has an inside provided with a mounting hole 111 for mounting the first support seat 40 and the second support seat 20. The mounting hole 111 of the carrier body 10 is surrounded by the sliding face 112. The mounting ring 11 of the carrier body 10 is provided with two opposite retaining grooves 113 to retain the first stop plate 41 of the first support seat 40 and the second stop plate 21 of the second support seat 20 respectively. The sliding face 112 of the mounting ring 11 is located between the two retaining grooves 113. The carrier body 10 has a second end provided with a connecting plate 12. The connecting plate 12 of the carrier body 10 is formed on an outer wall of the mounting ring 11. The connecting plate 12 of the carrier body 10 has two opposite sides each provided with a reinforcing ribs 121 and has a surface provided with a limit rod 121, a through bore 123 and a hanging hole 124.

The rolling module 30 is located between the first stop plate 41 of the first support seat 40 and the second stop plate 21 of the second support seat 20 and includes a plurality of rolling balls 31.

In assembly, the connecting tube 42 of the first support seat 40 is inserted into the mounting ring 11 of the carrier body 10, and the first stop plate 41 of the first support seat 40 is retained in one of the two retaining grooves 113 of the mounting ring 11. Then, the rolling module 30 is inserted between the mounting ring 11 of the carrier body 10 and the connecting tube 42 of the first support seat 40. Then, the reduced insert 221 of the engaging sleeve 22 is inserted through the guide slot 421 into the engaging hole 424 of the connecting tube 42 and is guided by the oblique guide face 422 of the connecting tube 42. Finally, the reduced insert 221 of the engaging sleeve 22 is stopped by the stop flange 426 of the connecting tube 42, and the second stop plate 21 of the second support seat 20 is retained in the other one of the two retaining grooves 113 of the mounting ring 11, so that the rolling module 30 is located between the first stop plate 41 of the first support seat 40 and the second stop plate 21 of the second support seat 20 and is slidably mounted between the sliding face 112 of the mounting ring 11 and the connecting tube 42 of the first support seat 40.

Figure 4:
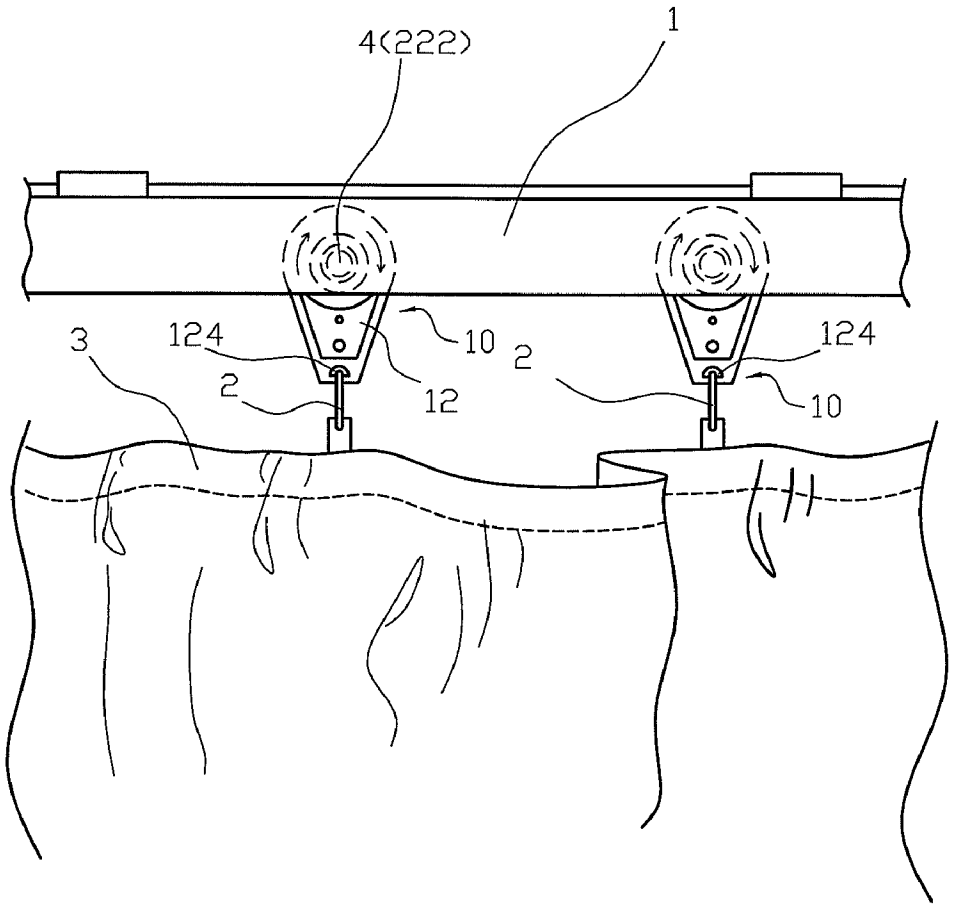
FIG. 4 is a front view showing practice of the curtain carrier as shown in FIG. 1.
Figure 5:
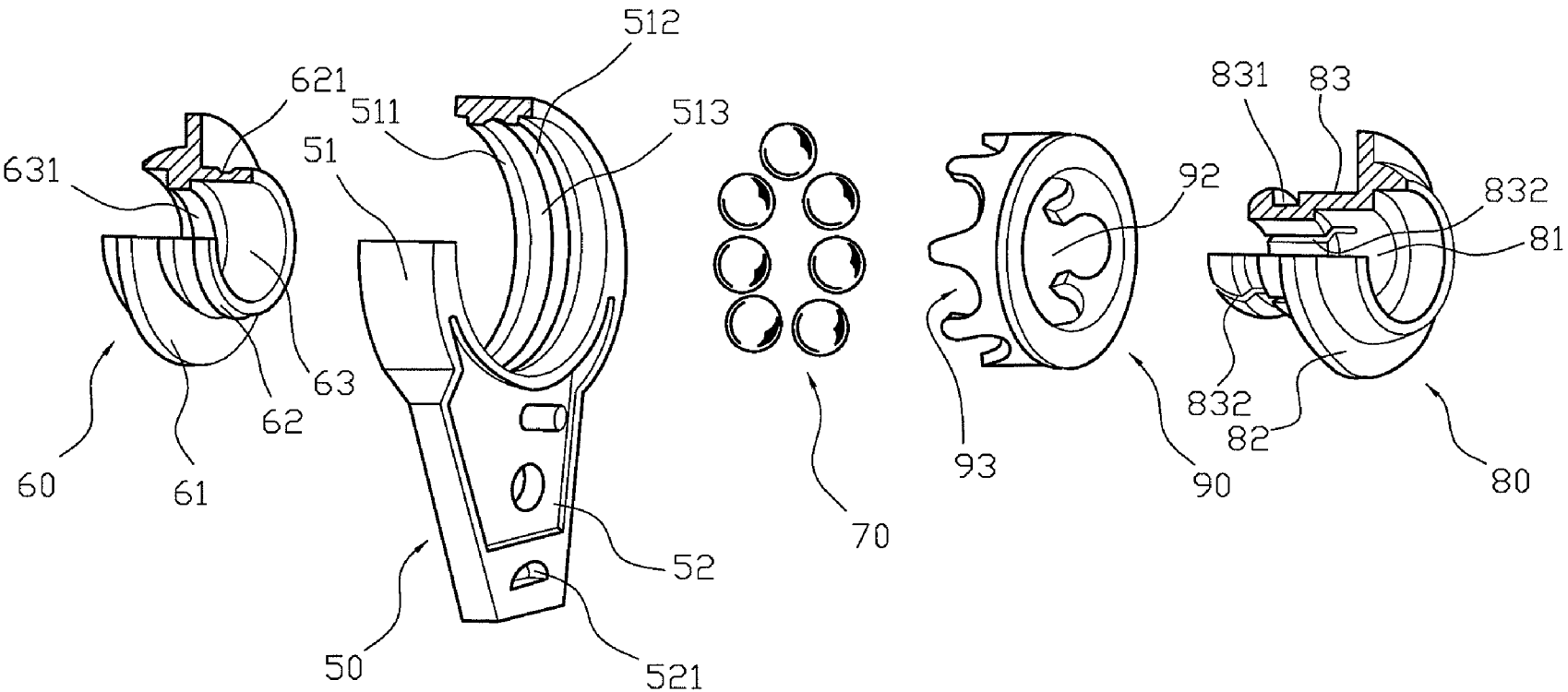
PRIOR ART FIG. 5
FIG. 5 is an exploded perspective view of a conventional curtain carrier in accordance with the prior art.
Figure 6:
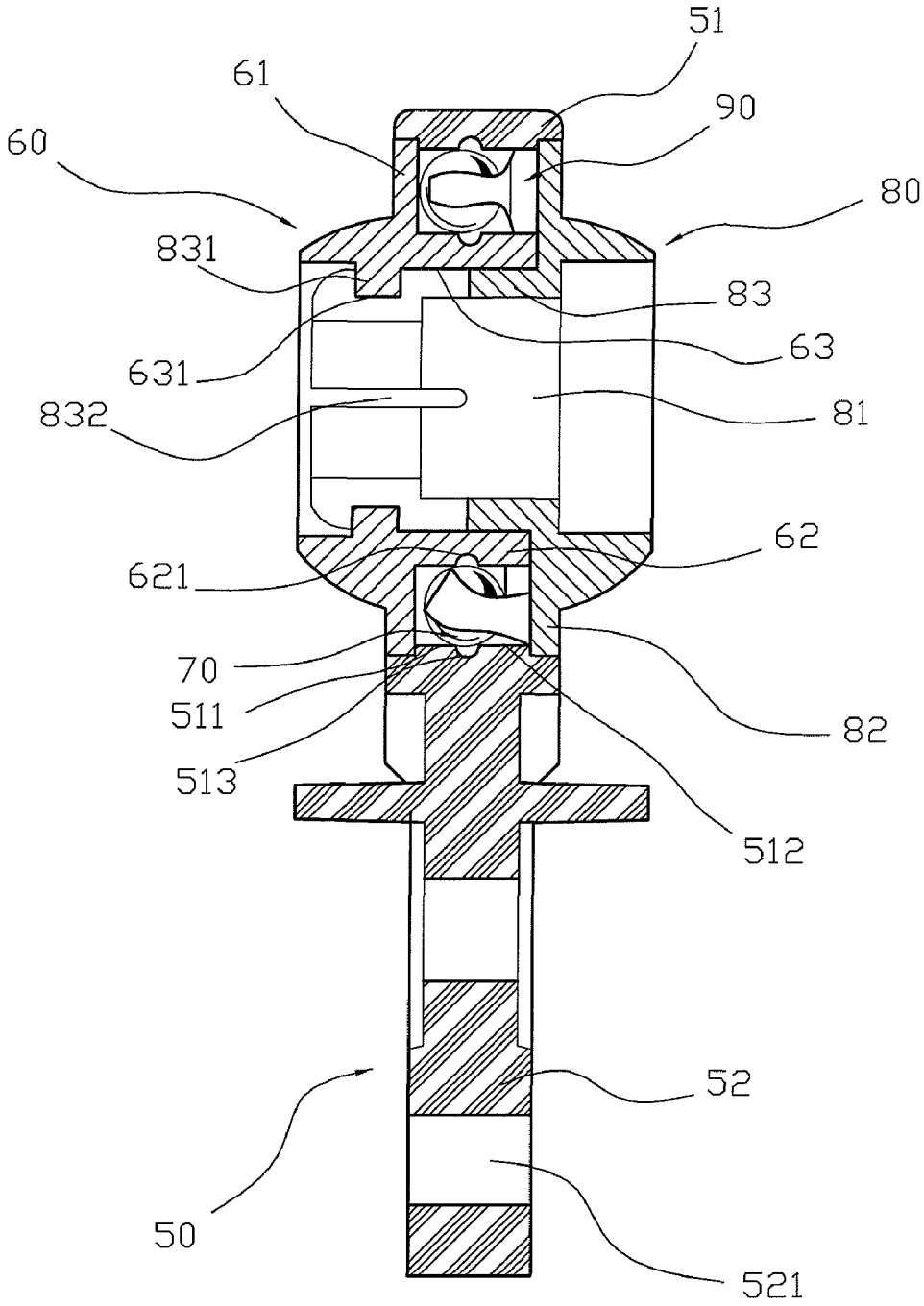
PRIOR ART FIG. 6
FIG. 6 is a side cross-sectional assembly view of the conventional curtain carrier as shown in FIG. 5.

In practice, referring to FIG. 4 with reference to FIGS. 1-3, the curtain carrier is used to attach a curtain cloth 3 to a headrail 1 via a hanging hook 2. A pivot rod 4 extends through the through hole 222 of the engaging sleeve 22 and is movable in the headrail 1 to attach the carrier body 10 to the headrail 1. The hanging hook 2 is hooked onto the hanging hole 124 of the connecting plate 12 to attach the curtain cloth 3 to the carrier body 10. Thus, when the curtain cloth 3 is pulled by a user, the carrier body 10 is moved in the headrail 1 so as to open or close the curtain cloth 3. At this time, the first support seat 40 and the second support seat 20 are rotatable relative to the mounting ring 11 of the carrier body 10 to facilitate movement of the carrier body 10. In addition, the rolling module 30 is slidably mounted between the sliding face 112 of the mounting ring 11 and the connecting tube 42 of the first support seat 40 to reduce the friction between the carrier body 10 and the first support seat 40 to facilitate rotation of the first support seat 40 relative to the carrier body 10.

Accordingly, the curtain carrier consists of a carrier body 10, a first support seat 40, a second support seat 20 and a rolling module 30, so that the curtain carrier has a simplified construction, thereby greatly decreasing the cost of fabrication. In addition, when the first support seat 40 and the second support seat 20 are combined, the reduced insert 221 of the engaging sleeve 22 is inserted through the guide slot 421 into the engaging hole 424 of the connecting tube 42 and is guided by the oblique guide face 422 of the connecting tube 42, so that the first support seat 40 and the second support seat 20 are assembled easily and quickly, thereby facilitating assembly of the curtain carrier.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A curtain carrier, comprising:

a carrier body having a first end provided with a mounting ring which has an inner wall provided with a sliding face;

a first support seat having a connecting tube which is inserted into the mounting ring of the carrier body and has an inner wall provided with an engaging hole;

a second support seat having an engaging sleeve which is inserted into and closely fit in the engaging hole of the connecting tube of the first support seat;

a rolling module located between the first support seat and the second support seat and slidably mounted between the sliding face of the mounting ring of the carrier body and the connecting tube of the first support seat;

wherein the engaging hole of the connecting tube has a first end provided with an enlarged guide slot to allow entrance of the engaging sleeve of the second support seat and a second end provided with a radially and inwardly extending stop flange to stop movement of the engaging sleeve of the second support seat;

the engaging sleeve of the second support seat has a first end provide with a reduced insert abutting the stop flange of the connecting tube;

the guide slot of the connecting tube has a side provided with an oblique guide face to guide movement of the engaging sleeve of the second support seat;

the reduced insert of the engaging sleeve is guided by the oblique guide face of the connecting tube.

2. The curtain carrier of claim 1, wherein the reduced insert of the engaging sleeve is inserted through the guide slot into the engaging hole of the connecting tube.

3. The curtain carrier of claim 1, wherein the first support seat has a first stop plate formed on an outer wall of the connecting tube and abutting the mounting ring of the carrier body;

the second support seat has a second stop plate formed on an outer wall of the engaging sleeve and abutting the mounting ring of the carrier body.

4. The curtain carrier of claim 3, wherein the engaging sleeve of the second support seat has a second end provided with the second stop plate.

5. The curtain carrier of claim 3, wherein the connecting tube of the first support seat has a first end abutting the second support seat and a second end provided with the first stop plate.

6. The curtain carrier of claim 5, wherein the first end of the connecting tube has an end face abutting the second stop plate of the second support seat.

7. The curtain carrier of claim 3, wherein the mounting ring of the carrier body is provided with two opposite retaining grooves to retain the first stop plate of the first support seat and the second stop plate of the second support seat respectively.

8. The curtain carrier of claim 7, wherein the sliding face of the mounting ring is located between the two retaining grooves.

9. The curtain carrier of claim 3, wherein the rolling module is located between the first stop plate of the first support seat and the second stop plate of the second support seat and includes a plurality of rolling balls.

10. The curtain carrier of claim 1, wherein the guide slot of the connecting tube has a stepped shape.

11. The curtain carrier of claim 1, wherein the reduced insert of the engaging sleeve has a stepped shape.

12. The curtain carrier of claim 1, wherein the reduced insert of the engaging sleeve has a thickness smaller than that of the engaging sleeve of the second support seat.

13. The curtain carrier of claim 1, wherein the mounting ring of the carrier body has an inside provided with a mounting hole for mounting the first support seat and the second support seat.

14. The curtain carrier of claim 13, wherein the mounting hole of the carrier body is surrounded by the sliding face.

15. The curtain carrier of claim 1, wherein the carrier body has a second end provided with a connecting plate.

16. The curtain carrier of claim 1, wherein the engaging sleeve of the second support seat has an inner wall provided with a through hole.

17. A curtain carrier, comprising:

a carrier body having a first end provided with a mounting ring which has an inner wall provided with a sliding face;

a first support seat having a connecting tube which is inserted into the mounting ring of the carrier body and has an inner wall provided with an engaging hole;

a second support seat having an engaging sleeve which is inserted into and closely fit in the engaging hole of the connecting tube of the first support seat;

a rolling module located between the first support seat and the second support seat and slidably mounted between the sliding face of the mounting ring of the carrier body and the connecting tube of the first support seat;

wherein the engaging hole of the connecting tube has a first end provided with an enlarged guide slot to allow entrance of the engaging sleeve of the second support seat and a second end provided with a radially and inwardly extending stop flange to stop movement of the en a in sleeve of the second support seat;

the engaging hole of the connecting tube has a diameter smaller than that of the guide slot and greater than that of the stop flange.

* * * * *